US005624072A

United States Patent [19]

Okajima et al.

[11] Patent Number: 5,624,072

[45] Date of Patent: Apr. 29, 1997

[54] FUEL INJECTION PUMP HAVING REDUCED REFLUX PULSATION EFFECTS

[75] Inventors: Masahiro Okajima, Anjo; Masaaki Kato, Kariya, both of Japan

[73] Assignee: Nippondenso Co., Ltd., Kariya, Japan

[21] Appl. No.: 434,399

[22] Filed: May 3, 1995

[30] Foreign Application Priority Data

May 13, 1994 [JP] Japan ..... 6-099682

[51] Int. Cl.[6] ..... F02M 45/02

[52] U.S. Cl. ..... 239/92; 239/124

[58] Field of Search ..... 239/94, 88, 89, 239/124

[56] References Cited

U.S. PATENT DOCUMENTS

| | | | |
|---|---|---|---|
| 2,173,812 | 9/1939 | Bischof | 239/93 X |
| 2,378,165 | 6/1945 | Waeber | 239/93 |
| 4,118,156 | 10/1978 | Ivosevic . | |
| 4,134,549 | 1/1979 | Perr | 239/92 |
| 4,951,874 | 8/1990 | Ohnishi et al. | 239/124 X |
| 5,207,301 | 5/1993 | Kruckemeyer et al. . | |

FOREIGN PATENT DOCUMENTS

| | | | |
|---|---|---|---|
| 192194 | 8/1986 | European Pat. Off. | 239/124 |
| 303237 | 2/1989 | European Pat. Off. . | |
| 1321217 | 2/1963 | France | 239/93 |
| 1491304 | 11/1967 | France . | |
| 1509914 | 4/1968 | France . | |
| 3928612 | 3/1991 | Germany . | |
| 2169858 | 6/1990 | Japan . | |
| 54359 | 3/1991 | Japan | 239/124 |

*Primary Examiner*—Kevin Weldon

*Attorney, Agent, or Firm*—Cushman, Darby & Cushman IP Group of Pillsbury Madison & Sutro LLP

[57] ABSTRACT

To provide a fuel injection pump which can sufficiently and stably supply fuel to a fuel pressurization chamber during a fuel intake stroke, a plunger chamber, a spill port and a spill passage are mutually communicable, while a reflux passage, an intake gallery, an intake passage, an intake port and the plunger chamber are mutually communicable. A reflux passage communicates with a damping chamber through a communication passage. The spill passage and the reflux passage communicate with each other, and when a spill valve opens, high-pressure fuel within the plunger chamber spills from the spill valve and into the intake gallery through the reflux passage, causing pulsation having a pressure level difference to the spill fuel. When the pulsation wave passes through the damping chamber, as the level difference in the pulsation wave is reduced, a sufficient quantity of fuel can stably be supplied from the intake gallery to the plunger chamber.

16 Claims, 8 Drawing Sheets

FUEL INJECTION PUMP HAVING REDUCED REFLUX PULSATION EFFECTS

CROSS-REFERENCE TO RELATED APPLICATION

This application claims priority under 35 U.S.C. §119 from Japanese Patent Application No. 6-99682, which is hereby incorporated by reference.

BACKGROUND OF THE INVENTION

1. Field of the Invention

The present invention generally relates to a fuel injection pump for an internal combustion engine.

2. Brief Description of the Related Art

Some prior art fuel injection systems include a fuel injection pump which uses a solenoid control valve as a spill valve and which controls fuel injection timing by spilling high-pressure fuel from a fuel pressurization chamber by opening and closing the spill valve, in which the spill fuel is refluxed to an intake gallery when fuel injection terminates and thereby the fuel supply rate to a plunger chamber for the next fuel intake stroke is secured to prevent a shortage in fuel supply to the plunger chamber. However, using this method of refluxing spill fuel to the intake gallery, a level difference in the fuel pressure within the intake gallery is created due to pulsation caused by the high-pressure spill fuel as illustrated by graph line 301 in FIG. 13. If the intake gallery pressure is high, the inner wall composing the intake gallery may be damaged; if the intake gallery pressure is low, a sufficient quantity of fuel can not be fed out into the plunger chamber. For these reasons, it is possible that fuel can not be supplied to the plunger chamber in a stable manner. Furthermore, even if the rotational pump speed rises, that is, even if the rotational engine speed rises, the level difference in the intake gallery pressure should preferably be within an allowable range as illustrated by graph line 302 in FIG. 14. However, since the level difference in the intake gallery pressure due to pulsation increases as the rotational engine speed increases as illustrated by the graph line 303 in FIG. 14, fuel injection characteristics falls particularly drastically at the high rotational engine speed range.

In order to solve the above problems, it is conceivable that a check valve is provided in a reflux passage through which fuel is refluxed from the spill valve to the fuel gallery and fuel flow is possible only in the direction from the intake gallery to the spill valve. In this arrangement, even if the pulsation is transmitted to the fuel within the intake gallery, when the fuel pressure is high, the check valve opens and the fuel flows to the spill valve, and when the fuel pressure is low, the check valve closes and the reflux of the fuel from the spill valve can be prevented, so that the fuel pressure within the intake gallery can be smoothed.

However, the conventional fuel injection pump provided with a check valve as described above cannot sufficiently flux the spill fuel to the intake gallery due to the check valve, and as a result, when the fuel is taken into the plunger chamber, the pressure within the intake gallery instantaneously falls and the fuel can not stably be supplied to the plunger chamber.

SUMMARY OF THE INVENTION

In view of the above problems, a primary object of the present invention is to provide a fuel injection pump which can sufficiently and stably supply fuel to a fuel pressurization chamber during the fuel intake stroke.

To achieve these and other objects, a first aspect of the present invention provides a fuel injection pump which spills the fuel from a fuel pressurization chamber by opening a spill valve when fuel is being injected and refluxes a part of this spill fuel to the fuel pressurization chamber through a reflux passage, where the fuel injection pump includes a pulsation reducing device provided in the reflux passage which reduces the pulsation of the fuel refluxed to the fuel pressurization chamber.

The pulsation reducing device may be a pulsation reduction chamber communicating with the reflux passage through a communication passage. Moreover, the pulsation reducing device may be a pulsation reduction passage, where the cross-sectional area of the pulsation reduction passage is larger than that of upstream and downstream portions of the reflux passage proximate to the pulsation reduction passage.

The length of the pulsation reduction passage, the upstream side of the reflux passage proximate to the pulsation reduction passage, and the downstream side of the reflux passage proximate to the pulsation reduction passage may preferably be formed at a preset ratio. Also, the pulsation reducing device may include a check valve which closes in the direction opposite to a flow of fuel from the fuel pressurization chamber to the spill valve, and it may additionally or alternatively include an orifice. Furthermore, the pulsation reducing device may include a pulsation reducing valve composed of a check valve and an orifice which can pass fuel therethrough from the fuel pressurization chamber to the spill valve even if the check valve closes.

The check valve may be provided on the upstream side or downstream side of the reflux passage proximate to the pulsation reduction passage. Additionally, the orifice may be disposed in similar locations.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments according to the present invention will now be described referring to the appended drawings.

Figure 1:
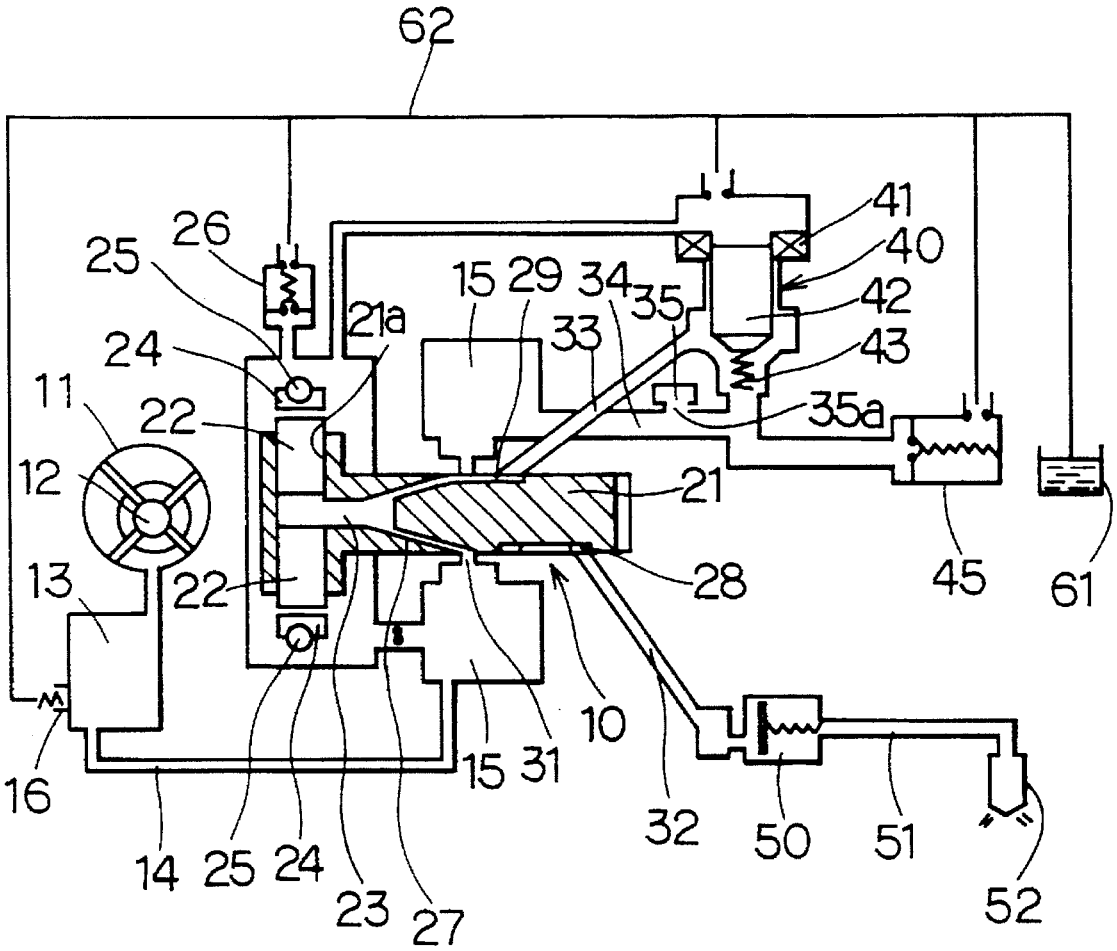
FIG. 1 is a compositional view illustrating a fuel injection pump according to a first embodiment of the present invention.

A fuel injection pump according to a first embodiment of the present invention is illustrated in FIG. 1. In this Figure, a vane-type feed pump 11 of an injection pump 10 rotates in synchronization with a drive shaft 12 driven by an engine (not shown) and pressurizes fuel taken in from a fuel tank 61. The pressurized fuel is accumulated within a feed gallery 13 and supplied to an intake gallery 15 through a fuel pipe 14. A regulating valve 16 regulates the fuel feed pressure of the vane-type feed pump 11 so that the fuel feed pressure can rise in proportion to the rotational speed of the vane-type feed pump 11.

The intake gallery 15 is annularly formed around a distributing rotor 21. The distributing rotor 21 is connected to the drive shaft 12 in the axial direction and rotates integrally with this drive shaft 12.

The distributing rotor 21 includes a pair of sliding holes 21*a* intersecting at right angles. The inner walls of the distributing rotor 21 forming the pair of sliding holes 21*a* oil tightly and slidably support a pair of plungers 22 respectively. The inner walls of the distributing rotor 21 forming the inner end surfaces of the pair of plungers 22 and sliding holes 21*a* respectively also sectionally form a plunger changer 23.

A shoe 24 is disposed at the outside end part of each plunger 22, and each shoe 24 rotatably holds a roller 25. A cam surface with a plurality of cam peaks on the inner periphery thereof is formed on an inner cam ring (not shown) disposed on the outside of the roller. Accordingly, when the roller 25 slides on the cam surface provided on the inner periphery of the inner cam ring according to the rotation of the distributing rotor 21, the roller 25 reciprocates along the cam surface in the radial direction of the inner cam ring, and this reciprocation is transmitted to the above plunger 22 through the shoe 24. A stroke of this plunger 22 to move to the outside in the radial direction of the distributing rotor 21 is a fuel intake stroke, and a stroke of the plunger 22 to move to the inside in the radial direction of the distributing rotor 21 is a fuel press feed stroke. During the fuel press feed stroke driven by the reciprocation of the plunger 22, surplus fuel is returned to the fuel tank 61 through a fuel return pipe 62 by a cam overflow valve 26.

The distributing rotor 21 includes an intake port 27 communicating with the plunger chamber 23, a distribution port 28 and a spill port 29 which can communicate with an intake passage 31, a distribution passage 32 and a spill passage 33 respectively according to the rotation of the distributing rotor 21. In the case of a pb 6-cylinder engine, for example, the intake port 27 communicates with the intake passage 31 for a period occurring every 60° of the rotation of rotor 21.

The spill valve 40 is disposed in the far end of the spill passage 33. The spill valve 40 selectively establishes a communication passage between the spill passage 33 and a reflux passage 34 and closes the same passage during the fuel press feed stroke, and controls the fuel injection rate by controlling the delivery timing and spill timing of the pressurized fuel. When an excitation coil 41 is energized and excitation current is supplied thereto, a valve plunger 42 against the return force of a compression coil spring 43 and thereby the spill valve 40 is closed. When the power to excitation coil 41 is terminated, the valve plunger 42 lifts and communication between the spill passage 33 and the reflux passage 34 is established so that the fuel within the plunger chamber 23 refluxes to the intake gallery 15. A damper chamber 35 functioning as a pulsation reducing device for the spill fuel communicates with the reflux passage 34 through a communication passage 35*a*. The reflux passage 34 is partially connected to an overflow valve 45.

A delivery valve 50 is connected to the distribution passage 32. When the fuel pressurized within the plunger chamber 23 exceeds a preset pressure level, the delivery valve 50 opens to feed the high-pressure fuel to an injection nozzle 52 through an injection pipe 51.

Figure 3:
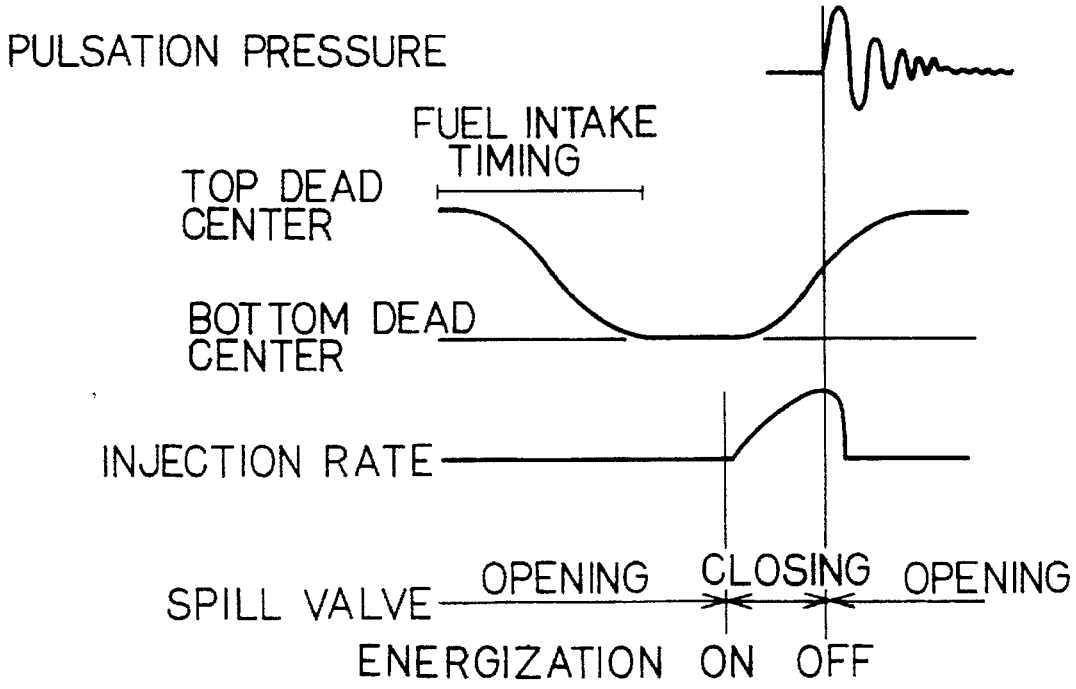
FIG. 3 is a graph illustrating the characteristics of the fuel intake stroke and fuel press feed stroke according to the first embodiment of the present invention.

Next, the operation of the injection pump 10 will be described based on FIGS. 1 and 3.

The communication of the intake port 27 with the intake passage 31 is set to the period when the plunger 22 moves from the top dead center to the bottom dead center. During this period, the fuel is taken in from the intake gallery 15 to the plunger chamber 23.

When exciting current is supplied to the exciting coil 41 when the plunger 22 reaches the bottom dead center and then moves to the top dead center, the valve 42 lowers against the return force of the compression coil spring 43 and the spill valve 40 is closed. Concurrently, the distribution port 28 communicates with the distribution passage 32. When the fuel pressure within the plunger chamber 23 exceeds a preset pressure level, the delivery valve 50 opens, and the fuel is press fed from the injection pipe 51 to the injection nozzle 52 and injected therefrom into a combustion chamber of each engine cylinder (not shown). When the fuel injection rate reaches a preset value, the electric energization of the spill valve 40 is terminated and the spill valve 40 opens. When the spill valve 40 opens, the spill passage 33 and the reflux passage 34 communicate with each other, and the high-pressure fuel flows from the reflux passage 34 into the intake gallery 15.

Figure 2:
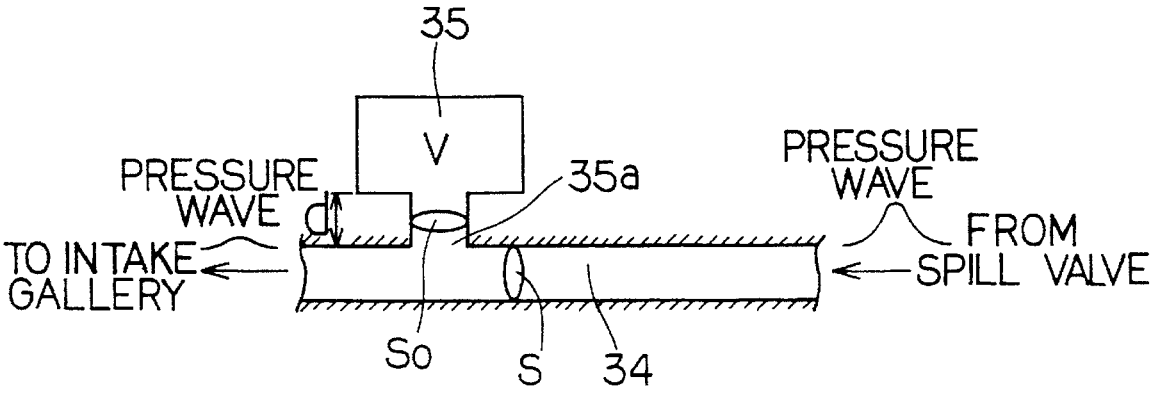
FIG. 2 is representative diagram illustrating a pulsation reducing device according to the first embodiment of the present invention.

The operation of the damper chamber 35 in the event of fuel spill will now be described. As illustrated in FIG. 2, pulsation pressure is caused immediately in front of the damper chamber 35 due to the fuel spilled into the reflux passage 34, and the pulsation pressure moves toward to the intake gallery 15. When a high-pressure wave of the pulsation pressure reaches the damper chamber 35, the energy of the high-pressure wave is absorbed into the damper chamber 35, and as a result, the pressure within the damper chamber 35 rises and the pressure of the spill fuel within the reflux passage 34 falls. Next, when a low-pressure wave of the pulsation pressure reaches the damper chamber 35, the energy of the high-pressure wave absorbed into the damper chamber 35 is transferred to the low-pressure wave, and thereby the pressure of the spill fuel within the reflux passage 34 rises. As a result, the pulsation pressure of the spill fuel refluxing from the reflux passage 34 to the intake gallery 15 is smoothed and becomes lower than the upper pressure limit of the intake gallery 15 and higher than the minimum pressure required for fuel supply to the plunger chamber 23. Therefore, a sufficient quantity of fuel can be supplied to the plunger chamber 23 stably.

Figure 4:
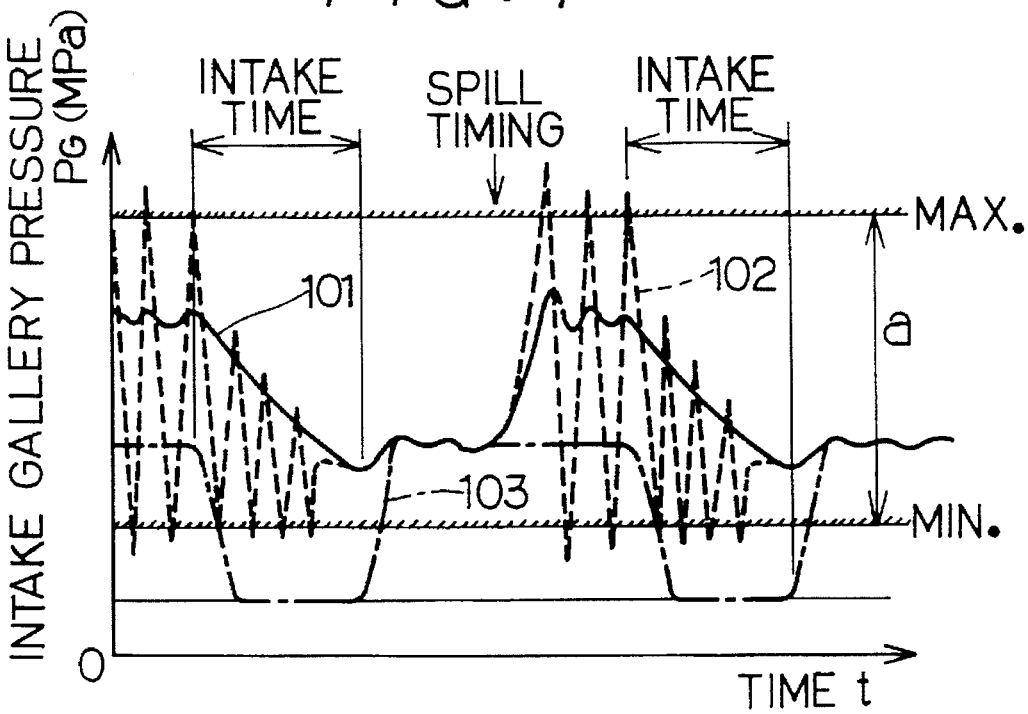
FIG. 4 is a characteristic diagram illustrating the relationship between the intake gallery pressure and time in a fuel injection pump according to the first embodiment, a first prior art system and a second prior art system.

Here, the relations between the elapsed time t and the intake gallery pressure PG according to the first embodiment, first and second prior art systems are illustrated in FIG. 4. The first prior art system is a typical system in which the spill fuel is directly refluxed to the intake gallery 15, and the second prior art system in a typical system in which the spill fuel is not directly refluxed to the intake gallery 15 (see, e.g., Japanese Unexamined Patent Publication No. Hei. 2-169858).

According to the first embodiment of the present invention, as illustrated by graph line 101, a slight pulsation is created after the fuel spill. Then, the fuel is supplied from the intake gallery 15 into the plunger chamber 23 during the fuel intake period and the intake gallery pressure $P_G$ gradually falls. However, since the intake gallery pressure $P_G$ is regulated within the proper range a between the minimum required pressure for reliable fuel supply to the plunger chamber 23 and the maximum permissible pressure for operation of the intake gallery 15, a sufficient quantity of fuel can be supplied into the plunger chamber 23 stably.

According to the first prior art system, the pulsation of the spill fuel directly induces the pulsation of the pressure of the intake gallery 15. Therefore, as illustrated by the graph line 102, the pressure of the intake gallery 15 is outside the proper range a on both sides of the minimum required pressure and the maximum permissible pressure due to the pulsation after the fuel spill. Consequently, a sufficient quantity of the fuel cannot be supplied to the intake gallery 15 and the intake gallery pressure $P_G$ may fall below the minimum required pressure during the fuel intake period. As a result, the quantity of fuel to be supplied to the plunger chamber 23 is not sufficient, and stable fuel injection can not be maintained.

According to the second prior art system represented by graph line 103, since the spill fuel is not directly refluxed to the intake gallery 15, the pressure within the intake gallery 15 does not rise even after the fuel spill and is much lower than the minimum required value during the fuel intake period. For this reason, the quantity of the fuel supply to the plunger chamber 23 is far below the minimally sufficient level, and stable fuel injection can not be maintained.

The effect of this embodiment will now be verified using the transmission loss TL of the damper chamber 35. The transmission loss TL of the damper chamber 35 can be obtained from Equations 1A–1C:

$$TL = 10\log_{10}\left[1+\left(\frac{\frac{\sqrt{C_0 V}}{2S}}{\frac{f}{f_0}-\frac{f_0}{f}}\right)^2\right] \quad (1A)$$

-continued $$f_0 = \frac{C}{2\pi}\sqrt{\frac{C_0}{V}} \quad (1B)$$

$$C_0 = \frac{S}{d+0.8\sqrt{S_0}} \quad (1C)$$

where C is the velocity of sound, $f_0$ is the resonance frequency of the damper chamber 35, f is the pulsation frequency, S is the cross-sectional area of the reflux passage, $S_0$ is the cross-sectional area of the communication passage, d is the length of the communication passage, and V is the volume of damper chamber. When the difference between the pulsation frequency f and the resonance frequency $f_0$ is reduced, the transmission loss TL increases, and the level difference in the pulsation pressure can be reduced.

The effect of reducing the level difference in the pulsation pressure of the damper chamber 35 according to the first embodiment can be confirmed by noting that the reduction in sound energy could be accomplished as a means to counter the noise. The transmission loss TL of sound can be obtained from Equation 2:

$$TL = 10\log_{10}\left(\frac{I_0}{I}\right) \quad (2)$$

where I is the energy of transmitted sound in watts per square meter and $I_0$ is the energy of injected sound in watts per square meter. The transmission loss TL indicates the difference between the transmission sound energy I and the injection sound energy $I_0$ expressed in decibels. Furthermore, since there is a relationship between the transmission sound energy I and the injection sound energy $I_0$ is expressed by the following Equation 3, Equation 2 can be replaced by Equation 4.

$$I = \frac{P^2}{\rho C} \quad (3)$$

$$TL = 20\log_{10}\left(\frac{P_0}{P}\right) \quad (4)$$

where ρ is the medium density, C is the velocity of sound, P is the transmission sound pressure in microbars, and $P_0$ is the injection sound pressure in microbars. Here, since the transmission sound pressure P is equivalent to the pulsation pressure $\Delta P_G$ of the intake gallery 15 and the injection sound pressure $P_0$ is equivalent to the spill pulsation pressure $\Delta P_{SPV}$ due to the spill fuel, the equation 4 can be expressed by the following equation 5, where the pulsation pressure $\Delta P_G$ indicates waves in the pulsation pressure within the intake gallery 15, and the spill pulsation pressure $\Delta P_{SPV}$ indicates the level difference in the spill pulsation pressure within the spill valve 40.

$$\Delta P_G = \frac{\Delta P_{SPV}}{10^{\frac{TL}{20}}} \quad (5)$$

Figure 5:
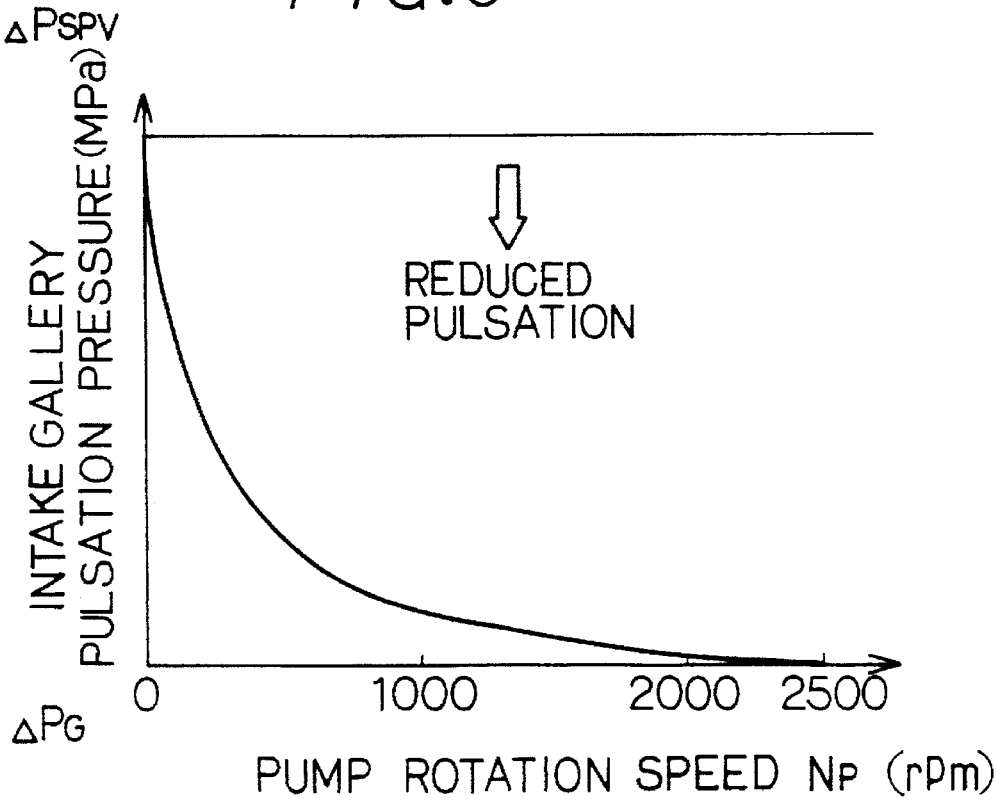
FIG. 5 is a graph illustrating the relationship between the rotational pump speed and intake gallery pulsation pressure according to the first embodiment of the present invention.

Here, the rotational pump speed $N_P$ and intake gallery pulsation pressure $\Delta P_G$ according to the first embodiment indicate the characteristics illustrated in FIG. 5. The measurement results illustrated in FIG. 5 were obtained by adjusting the pressure pulsation frequency at the maximum rotational pump speed of 2500 rpm and the resonance frequency of the damper chamber 35 to be equal and fixing the spill pulsation pressure $\Delta P_{SPV}$ before measurement. The intake gallery pulsation pressure $\Delta P_G$ within the low rotational pump speed range does not fall. In actuality, however, since the absolute value of the spill pulsation pressure $\Delta P_{SPV}$ is smaller than the measurement condition value within the low rotational pump speed range and the intake gallery pulsation pressure $\Delta P_G$ also falls, there is no problem. From these measurement results, as the level difference in the pulsation pressure of the spill pulsation waves is reduced by the pulsation reducing effect of the damper chamber 35, the spill fuel pressure to be refluxed to the intake gallery 15 is smoothed, and the fuel can stably be supplied to the plunger chamber 23.

Figure 6:
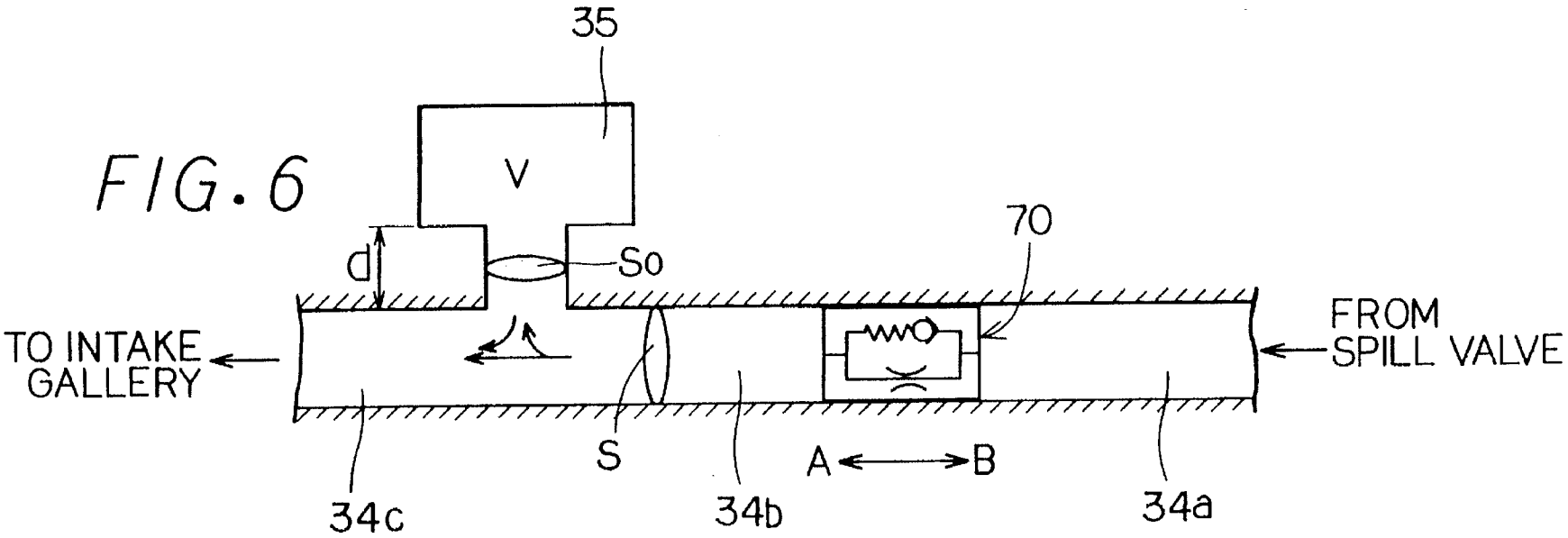
FIG. 6 is a representative view illustrating a pulsation reducing device for a fuel injection pump according to a second embodiment of the present invention.

A pulsation reducing device according to the second embodiment of the present invention is illustrated in FIG. 6. In this embodiment, a damping valve 70 as a pulsation reducing valve is provided on the upstream side of the spill fuel between the damper chamber 35 and the spill valve 40. The damping valve 70 permits fuel flow in the direction of arrow A as viewed in FIG. 6 with no interruption, while fuel flow in the direction of arrow B as viewed in FIG. 6 is possible only through the orifice, since the damping valve 70 is closed.

Figure 7:
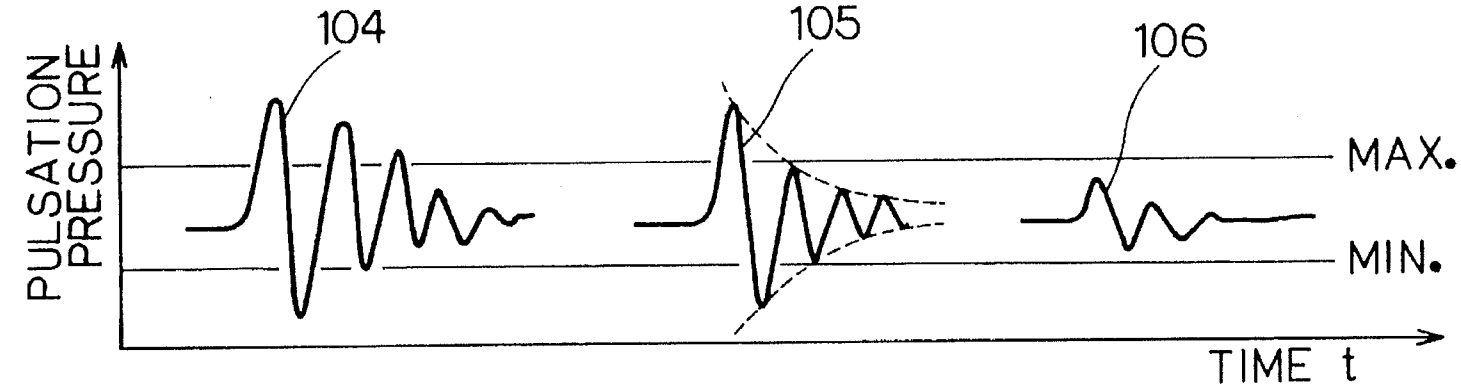
FIG. 7 is a descriptive view illustrating the pulsation reducing process of the pulsation reducing device according to the second embodiment of the present invention.

For this structure, the damping valve 70 can prevent further fluctuations in the pulsation pressure of the spill fuel due to the reflected wave in the direction of arrow B as viewed in FIG. 6 caused by the reflection of the fuel on the intake gallery 15 after passing through the damping valve 70. When passing through the damping valve 70, the spill fuel in a reflux position 34*a* within the reflux passage 34 having the pulsation pressure illustrated by graph line 104 in FIG, 7 can improve the pulsation damping characteristics as illustrated by graph line 105 in FIG. 7. In this way, in a point 34*c* at which point the pulsation pressure waves having high damping characteristics have passed through the damping chamber 35, as illustrated by graph line 106 in FIG. 7, the pulsation pressure is smoothed in the same way as is in the first embodiment, and fuel having a more stable pressure than that of the first embodiment is refluxed to the intake gallery 15 and fills the same.

In the second embodiment, the damping valve 70 as a pulsation reducing valve having the functions of a check valve and an orifice is provided on the upstream side of the damper chamber 35. In the present invention, however, it is possible to provide only a check valve or an orifice on the upstream side of the damper chamber 35. Furthermore, in the present invention, even if the damper chamber 35 as a pulsation reducing chamber is not provided and only the damping valve 70 as a pulsation reducing valve is provided in the reflux passage 34, the pulsation reducing effect can be obtained to some degree. Moreover, even if only the check valve or orifice part is provided in the reflux passage 34, the pulsation reducing effect can be obtained to some degree.

Figure 8:
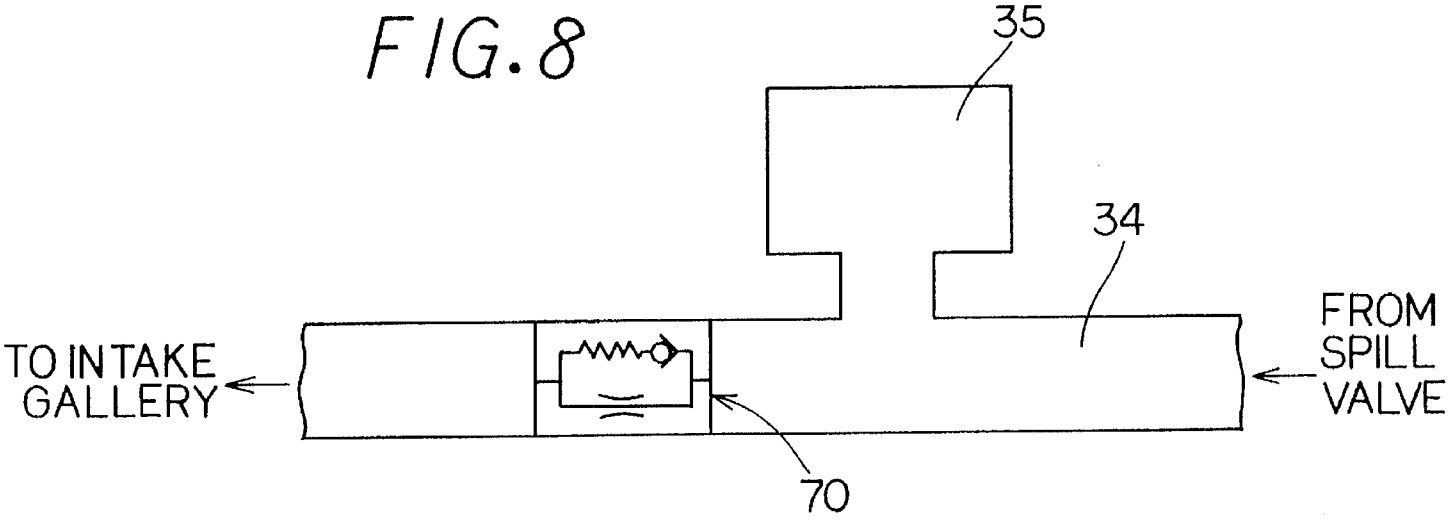
FIG. 8 is a descriptive view illustrating the pulsation reducing process of a pulsation reducing device according to a third embodiment of the present invention.

A pulsation reducing device according to the third embodiment of the present invention is illustrated in FIG. 8. In this embodiment, the damping valve 70 is provided on the downstream side of the spill fuel from the damping chamber 35. In this embodiment, the pulsation pressure of the damping chamber 35 is smoothed, and then the pulsation damping characteristics are improved by the damping valve 70, but fuel having stable pressure is refluxed to the intake gallery 15 in the same way as in the second embodiment.

In the third embodiment, the damping valve 70 as a pulsation reducing valve having the functions of a check valve and an orifice is provided on the downstream side from the damper chamber 35. In the present invention, however, it is possible to provide only a check valve or an orifice on the downstream side of the damper chamber 35.

Figure 9:
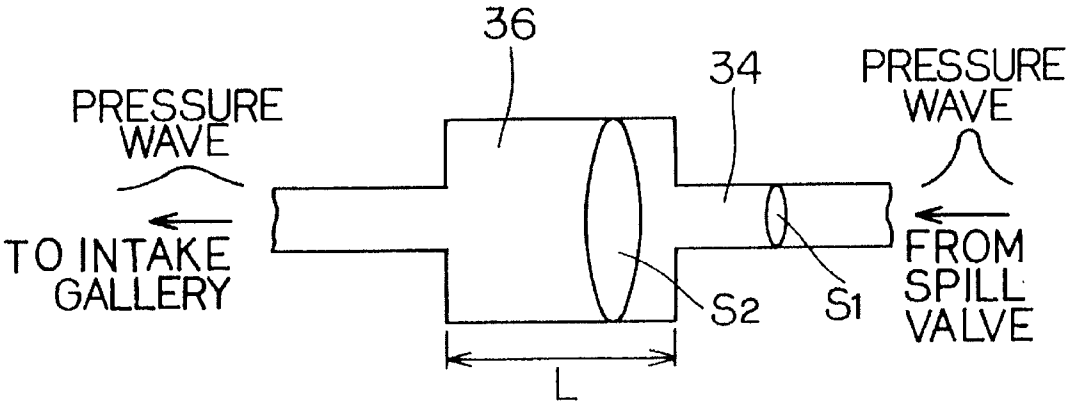
FIG. 9 is a descriptive view illustrating the pulsation reducing process of a pulsation reducing device according to a fourth embodiment of the present invention.

A pulsation reducing device according to the fourth embodiment of the present invention is illustrated in FIG. 9. In this embodiment, instead of the damper chamber 35 communicating with the reflux passage 34 through the communication passage 35*a*, an accumulation chamber 36 is provided as a part of the reflux passage 34. It is readily apparent that the accumulation chamber 36 has a cross-sectional area larger than that of the portions of the reflux passage 34 upstream and downstream of the accumulation chamber 36.

The transmission loss TL of the accumulation chamber 36 can be obtained from Equations 6A–6C:

$$TL = 10\log_{10}\left[1+\frac{1}{4}\left(m-\frac{1}{m}\right)^2 \sin^2 KL\right] \tag{6A}$$

$$m = \frac{S_2}{S_1} \tag{6B}$$

$$K = \frac{2\pi f}{C} \tag{6C}$$

where C is the velocity of sound, f is the pulsation frequency, $S_1$ is the cross-sectional area of the reflux passage, $S_2$ is the cross-sectional area of the accumulation chamber, and L is the length of the accumulation chamber. When $\sin^2 KL=1$, TL is largest, that is, when L=C/4f, TL is the largest, and the level difference in the pulsation pressure is reduced.

Figure 10:
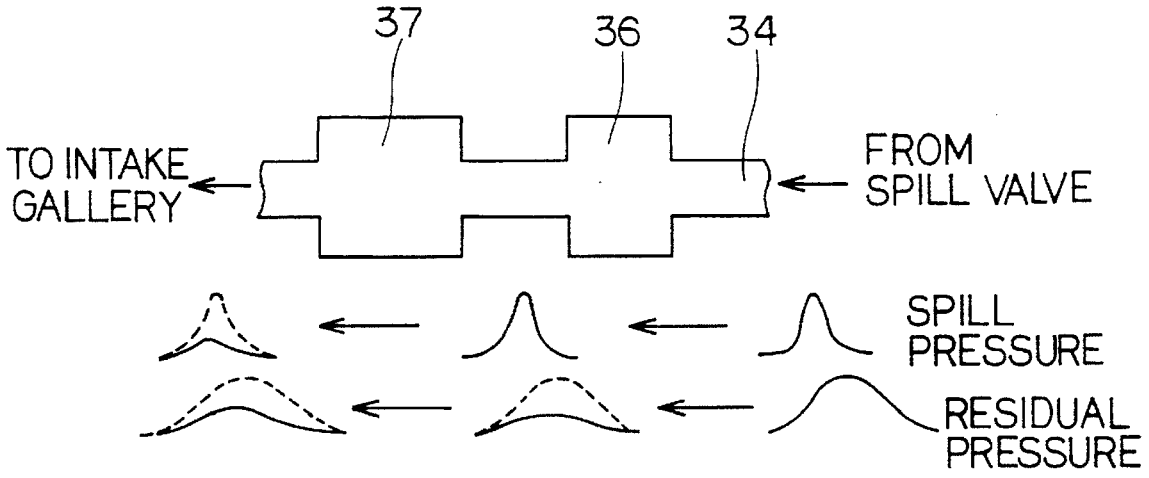
FIG. 10 is a descriptive view illustrating the pulsation reducing process of a pulsation reducing device according to a fifth embodiment of the present invention.

A pulsation reducing means according to the fifth embodiment of the present invention is illustrated in FIG. 10. In this embodiment, the pulsation pressure is caused not only by the pulsation due to the spill fuel but also by the delivery pulsation due to the residual delivery pressure from the plunger chamber 35 after the fuel spill. In order to smooth the respective pulsation pressures, an accumulation chamber having dimensions in accordance with the respective pulsation frequencies should be provided. For this reason, in the fifth embodiment, two accumulation chambers 36 and 37 are provided in the reflux passage 34.

In the fifth embodiment, two accumulation chambers 36 and 37 are provided as parts of the reflux passage 34. It is possible to provide three or more accumulation chambers to reduce pulsation pressures from other sources as well.

Figure 11:
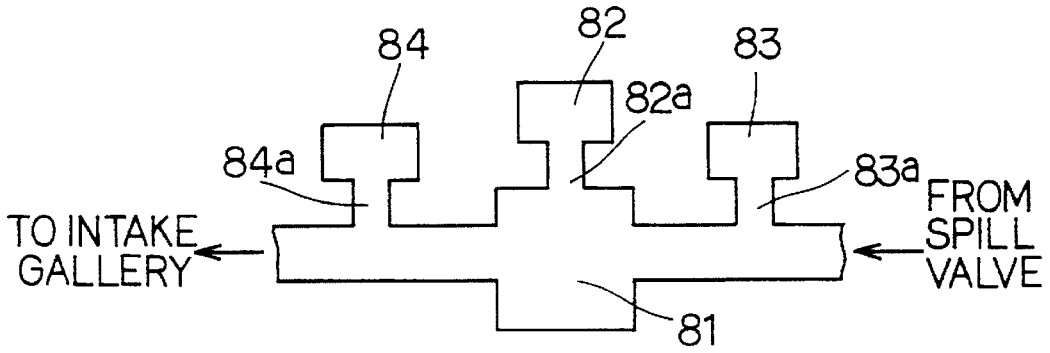
FIG. 11 is a descriptive view illustrating the pulsation reducing process of a pulsation reducing device according to a sixth embodiment of the present invention.

A pulsation reducing device according to the sixth embodiment of the present invention is illustrated in FIG. 11.

Either the damper chamber or the accumulation chamber is provided in the first embodiment through fifth embodiments described above. In the sixth embodiment, however, an accumulation chamber 81 is provided as a part of the reflux passage 34, and a damper chamber 82 is provided is communicating with the accumulation chamber 81 through a communication passage 82*a*. Furthermore, damper chambers 83 and 84 communicating with the upstream side and downstream side of the spill fuel from the accumulation chamber 81 through communication passages 83*a* and 84*a* respectively. The purpose of providing the accumulation chamber 81 and the damper chambers 82, 83 and 84 is to smooth the pulsation pressure resulting from a plurality of concurrent causes in the same way as in the fifth embodiment.

According to the present invention, fuel having more stable pressure can be refluxed to the intake gallery 15 by optimally combining the accumulation chamber 81 and damper chambers 82, 83 and 84.

Figure 12:
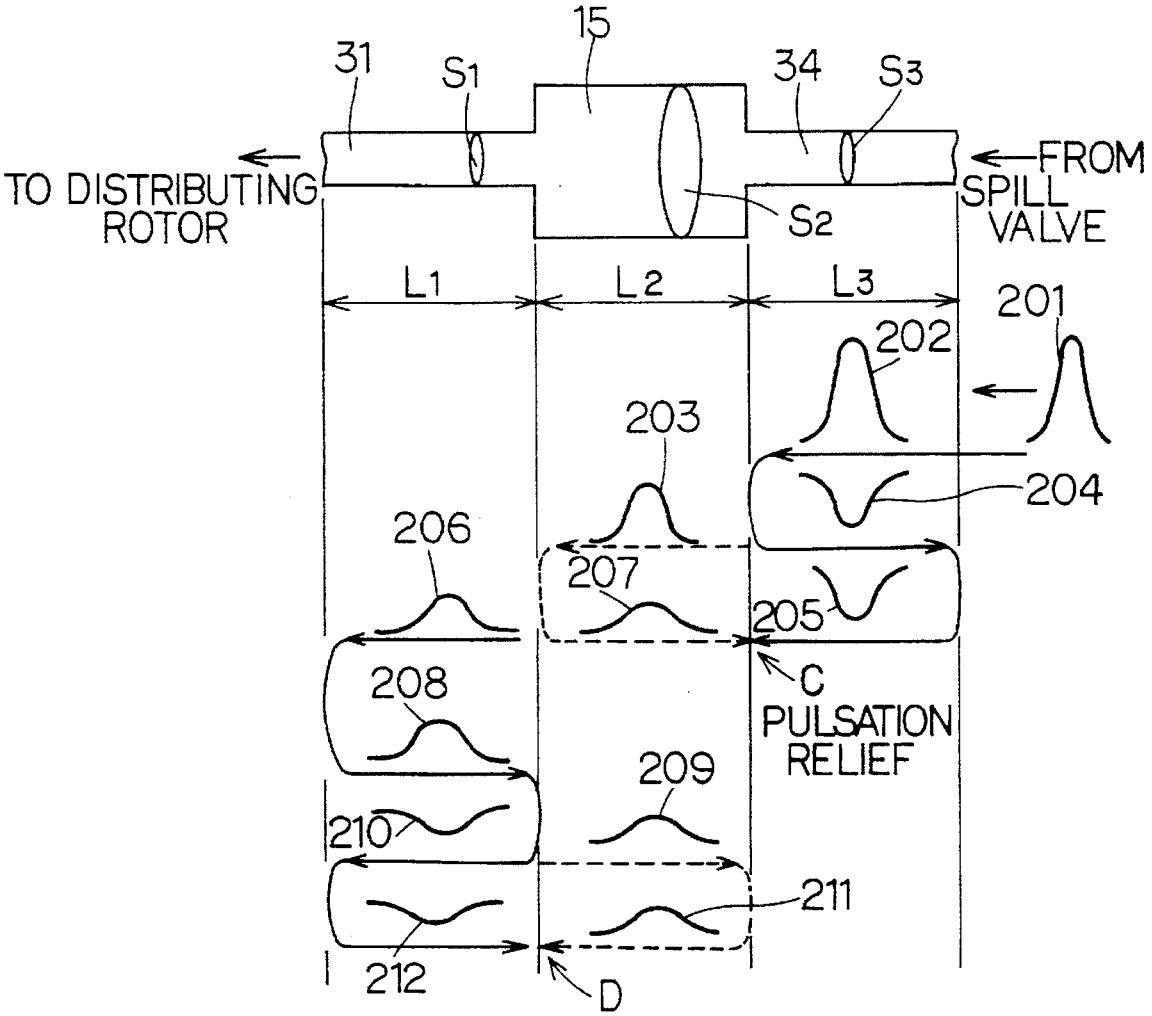
FIG. 12 is a descriptive view illustrating the pulsation reducing process of a pulsation reducing device according to a seventh embodiment of the present invention.
Figure 13:
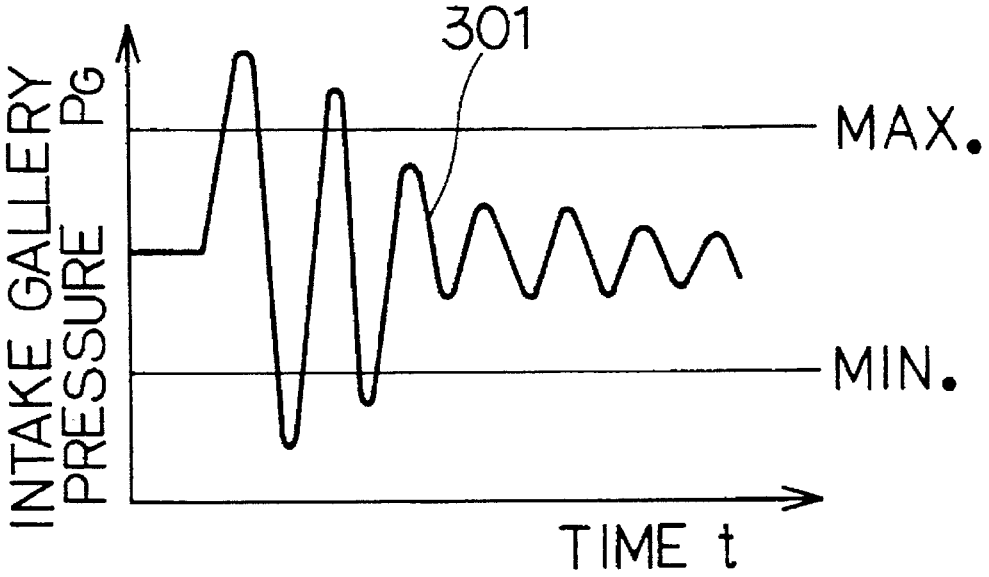
FIG. 13 PRIOR ART
FIG. 13 is a characteristic diagram illustrating the relation between the intake gallery pressure and time in a conventional fuel injection pump.
Figure 14:
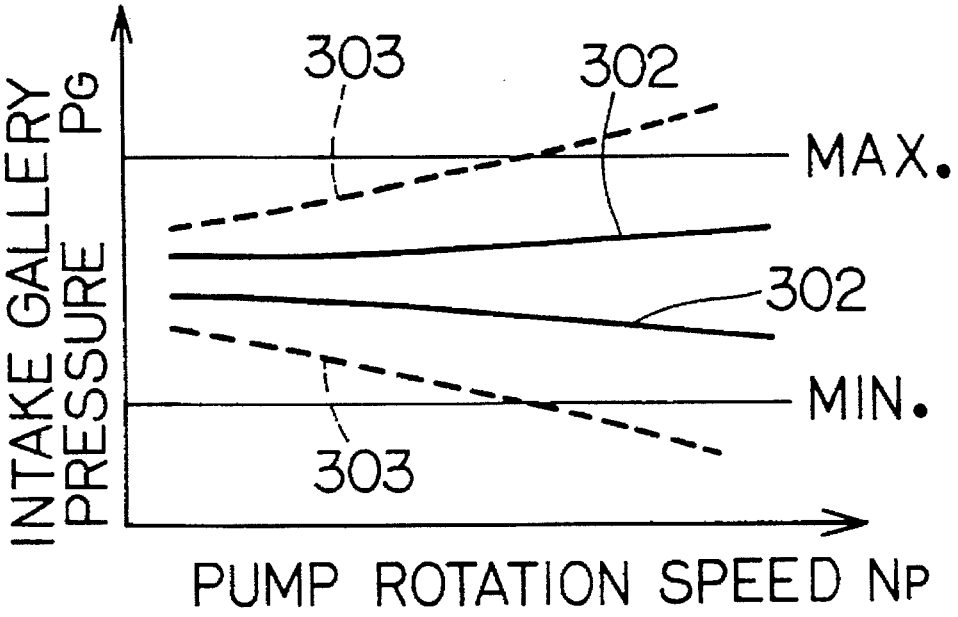
FIG. 14 is a graph illustrating the relationship between the intake gallery pressure and time in a conventional fuel injection pump.

A pulsation reducing device according to the seventh embodiment of the present invention is illustrated in FIG. 12. In FIG. 12, $S_1$ is the cross-sectional area of the intake passage, $S_2$ is the cross-sectional area of the intake gallery, $S_3$ is the cross-sectional area of the reflux passage, $L_1$ is the length of the intake passage, $L_2$ is the length of the intake gallery, and $L_3$ is the length of the reflux passage.

If there is no space available for the installation of the damper chamber 35 and the accumulation chambers 82, 83 and 84, the intake gallery 15 may be used as an accumulation chamber according to the seventh embodiment. Nevertheless, if the cross-sectional area $S_2$ of the intake gallery 15 large enough to smooth the pulsation pressure can not be secured, a part of the pulsation pressure wave is transmitted to the intake passage 31 through the intake gallery 15. However, if the dimensions $L_1$, $L_2$ and $L_3$ are set at a 1:1:1 ratio, the pulsation pressure can be smoothed as described below.

The spill fuel which is the pulsation pressure wave caused by the opening of the spill valve 40 has a pressure wave 201. This pressure wave 201 refluxes to the reflux passage 34 and becomes an input wave 202 having almost the same energy as that of the pressure wave 201. When the input wave 202 reaches the intake gallery 15, a part thereof becomes a transmission wave 203 and the other part becomes a reflection wave 204 having negative energy according to the ratio of the cross-sectional area $S_3$ of the reflux passage 34 to the cross-sectional area $S_2$ of the intake gallery 15. The reflection wave 204 collides against the spill valve 40, becomes a reflection wave 205 having negative energy, and advances to the intake gallery 15. When flowing from the intake gallery 15 into the intake passage 31, the transmission wave 203 becomes a transmission wave 206 and a reflection wave 207 according to the ratio of the cross-sectional area $S_2$ of the intake gallery 15 to the cross-sectional area $S_1$ of the intake passage 31. The reflection wave 207 collides against the reflection wave 205, the positive pulsation energy and the negative pulsation energy interfere with each other in the position C, and the level difference in the pulsation pressure is reduced. The transmission wave 206 collides against the outer wall of the distributing rotor 21 and becomes a reflection wave 208 until the intake passage 31 and the intake port 27 formed in the distributing rotor 21 communicate with each other. When is reaches the intake gallery 15 from the intake passage 31, the reflection wave 208 becomes a transmission wave 209 and a reflection wave 210. When reaching the reflex passage 34 from the intake gallery 15, the transmission wave 209 becomes a transmission wave (not shown) and a reflection wave 211. The reflection wave 210 collides against the outer wall of the distributing rotor 21 and becomes a reflection wave 212, and then collides against the reflection wave 211 at position D, whereby the positive pulsation energy and the negative pulsation energy interfere with each other and the level difference in the pulsation pressure is reduced. For this reason, even if a sufficiently large cross-sectional area of the intake gallery 15 can not be provided, the level difference in the pulsation pressure is reduced during the period until the intake passage 31 communicates with the intake port 27, and the pulsation pressure can be smoothed.

In the seventh embodiment, the pulsation pressure is smoothed by setting $L_1$, $L_2$ and $L_3$ to the ratio 1:1:1. In the present invention, however, it is possible to set the values including the cross-sectional area $S_1$ of the intake passage 31, the cross-sectional area $S_2$ of the intake gallery 15 and the cross-sectional area $S_3$ of the reflux passage 34 are set so that the pulsation pressure can be smoothed optimally.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A fuel injection pump comprising:

a pressurizing feed pump for pressurizing fuel from a fuel tank;

an intake gallery downstream from the pressurizing feed pump for receiving pressurized fuel from the pump;

a fuel pressurizing part for press feeding fuel taken in from the intake gallery via an intake passage, the fuel pressurizing part including a rotatably displaceable distributing rotor within a plunger chamber and a plunger for pressurizing and depressurizing fuel within the plunger chamber by rotating integrally with the distributing rotor and reciprocating;

an injection nozzle for injecting fuel press fed from the fuel pressurizing part through a distribution passage;

a spill valve for opening to spill fuel from the fuel pressurizing part through a spill passage when fuel injection is terminated; and a reflux passage for refluxing fuel to the intake gallery when the spill valve opens; wherein the distributing rotor includes a distribution port communicating with the distribution passage when fuel within the plunger chamber is pressurized, an intake port communicating with the intake passage when fuel within the plunger chamber is depressurized, and a spill port communicating with the spill passage when fuel injection is terminated; and the fuel injection pump further comprises a pulsation reducing means in the reflux passage for reducing pulsation of fuel refluxed to the intake gallery.

2. The fuel injection pump according to claim 1, wherein the pulsation reducing means includes a pulsation reduction chamber communicating with the reflux passage through a communication passage.

3. The fuel injection pump according to claim 1, wherein the pulsation reducing means includes a plurality of pulsation reduction chambers communicating with the reflux passage through respective communication passages.

4. The fuel injection pump according to claim 1, wherein the pulsation reducing means includes a pulsation reduction passage in the reflux passage, a cross-sectional area of the pulsation reduction passage being larger than a cross-sectional area of at least one of a portion of the reflux passage upstream of the pulsation reduction passage and a portion of the reflux passage downstream of the pulsation reduction passage.

5. The fuel injection pump according to claim 4, wherein a length of the pulsation reduction passage, a length of a portion of the reflux passage upstream of the pulsation reduction passage and a length of a portion of the reflux passage downstream of the pulsation reduction passage satisfy at a 1:1:1 ratio.

6. The fuel injection pump according to claim 4, wherein the pulsation reducing means further includes a pulsation reduction chamber communicating with the pulsation reduction passage through a communication passage.

7. The fuel injection pump according to claim 1, wherein the pulsation reducing means includes a plurality of pulsation reduction passages in the reflux passage, a cross-sectional area of each of the pulsation reduction passages being larger than a cross-sectional area of at least one of a corresponding portion of the reflux passage upstream of that pulsation reduction passage and a corresponding portion of the reflux passage downstream of that pulsation reduction passage.

8. The fuel injection pump according to claim 1, wherein the pulsation reducing means includes a check valve which closes in a direction opposite to a flow of fuel from the pressurizing feed pump to the spill valve.

9. The fuel injection pump according to claim 8, wherein the check valve is on an upstream side of a pulsation reduction passage.

10. The fuel injection pump according to claim 1, wherein the pulsation reducing means includes an orifice.

11. The fuel injection pump according to claim 10, wherein the orifice is on an upstream side of a pulsation reduction passage.

12. The fuel injection pump according to claim 1, wherein the pulsation reducing means includes a pulsation reducing valve composed of a check valve and an orifice capable of passing fuel from the pressurizing feed pump to the spill valve even when the check valve closes.

13. The fuel injection pump according to claim 12, wherein the pulsation reducing valve is provided on one of an upstream side and a downstream side of the pulsation reduction passage.

14. The fuel injection pump according to claim 8, wherein the check valve is on a downstream side of a pulsation reduction passage.

15. The fuel injection pump according to claim 10, wherein the orifice is on a downstream side of a pulsation reduction passage.

16. The fuel injection pump according to claim 12, wherein the pulsation reducing valve is provided on a downstream side of a pulsation reduction passage.

* * * * *